US006095577A

United States Patent [19]

Nolzen

[11] Patent Number: 6,095,577

[45] Date of Patent: Aug. 1, 2000

[54] LOCKING CLAMP FOR A MOTOR VEHICLE LOCKING MEANS

[75] Inventor: Gerd Nolzen, Wuppertal, Germany

[73] Assignee: Robert Bosch GmbH, Stuttgart, Germany

[21] Appl. No.: 09/161,496

[22] Filed: Sep. 28, 1998

[30] Foreign Application Priority Data

Sep. 27, 1997 [DE] Germany ..... 197 42 766

[51] Int. Cl.[7] ..... E05B 15/02

[52] U.S. Cl. ..... 292/340

[58] Field of Search ..... 292/340, 341.12, 292/216, 201; 228/173.6, 164

[56] References Cited

U.S. PATENT DOCUMENTS

| | | | |
|---|---|---|---|
| D. 303,754 | 10/1989 | Weinerman et al. | D8/344 |
| 2,723,151 | 11/1955 | Seyforth | 292/340 |
| 3,680,902 | 8/1972 | Slattery . | |
| 4,834,435 | 5/1989 | Kleefeldt | 292/340 |
| 4,883,298 | 11/1989 | Kleefeldt | 292/341.2 |
| 4,941,696 | 7/1990 | Yamada et al. | 292/340 |
| 4,998,759 | 3/1991 | Peterson et al. | 292/340 |
| 5,125,698 | 6/1992 | Thau | 292/340 |
| 5,263,752 | 11/1993 | Phail-Fausey et al. | 292/216 |
| 5,269,538 | 12/1993 | Strang | 292/341.12 |
| 5,316,354 | 5/1994 | Arabia, Jr. et al. | 292/340 |
| 5,348,357 | 9/1994 | Konchan et al. | 292/341.12 |
| 5,494,208 | 2/1996 | Granger | 228/173.6 |
| 5,494,324 | 2/1996 | Kleefeldt . | |
| 5,716,085 | 2/1998 | Kobayashi | 292/340 |

FOREIGN PATENT DOCUMENTS

| | | |
|---|---|---|
| 27 25 345 | 12/1978 | Germany . |
| 195 44 746 | 6/1996 | Germany . |

*Primary Examiner*—Lloyd A. Gall
*Attorney, Agent, or Firm*—Nixon Peabody LLP; David S. Safran

[57] ABSTRACT

A locking clamp for a motor vehicle locking arrangement having support body (2) which is bent from a single metal sheet into a U shape with a pair of legs and a connecting bridge, a part of which forms a base plate for attachment of the locking clamp to a chassis component, has a locking bolt (8) which extends between the ends of legs (6, 7), and is produced more easily in terms of production engineering without losing such necessary properties as tear strength by being formed as a bent extension of one of the legs (7) of the support body (2), in one piece therewith, which is joined securely at an end to the other of the leg.

11 Claims, 3 Drawing Sheets

LOCKING CLAMP FOR A MOTOR VEHICLE LOCKING MEANS

BACKGROUND OF THE INVENTION

1. Field of the Invention

The invention relates to a locking clamp for a motor vehicle locking means with a support body which is of a U-shape formed of a single bent metal sheet which has a pair of legs and a section that forms a base plate for attachment to a chassis component, and a locking bolt which is attached to one of legs of the support body so as to extend between ends of the legs of the support body for engaging a latch with an associated lock mechanism, a free space into which part of the latch is insertable is bounded by the support body and the locking bolt.

2. Description of Related Art

Locking clamps of the type to which the invention is directed are known as locking bolts, locking clips and key collars in various embodiments. A particular known locking clamp underlying the invention having a support body bent from a metal sheet in one piece in a U shape is disclosed in U.S. Pat. No. 3,680,902. In this known locking clamp, the base plate is formed by a leg of the support body, for which purpose the leg is widened in the manner of an eye above and below the opposing leg. In the eye-like enlargements the leg of the support body which forms the base plate countersunk holes are provided for mounting screws. The support body is provided with reinforcing beads in the area of this leg.

The leg which forms the base plate and the opposite leg each have through holes which are aligned with one another. A journal-like locking bolt is passed through and riveted on the back of the leg which forms the base plate, while on the front of the opposite leg the wider head of the socket journal is used as a stop. The insertion journal in the area between the legs is provided with a plastic sleeve and a metal anti-wear sleeve which surrounds it from the outside.

One alternative is to provide the insertion journal which forms the locking bolt with a screw thread on an end and to screw it into the chassis component itself.

U-shaped key collars bent in one piece entirely from a metal sheet are known, both as an inside key (German Patent Application No. DE 27 25 345 A1) and as an outside key. In neither case is there a part of the locking clamp which can be identified as a locking bolt; it is a type of locking clamp. A locking clamp of this type has also been known as a locking clamp that is molded in one piece as a chassis component for a hood closure (German Patent Application DE 195 44 746 A1).

SUMMARY OF THE INVENTION

The object of the present invention is to develop a locking clamp for a motor vehicle locking means with a support body bent into a U-shape of one piece metal sheet and a locking bolt in a way that it can be produced with minimum costs.

This object is achieved in a locking clamp, having a support body which is of a U-shape formed of a single bent metal sheet having a pair of legs and a section that forms a base plate for attachment to a chassis component, and a locking bolt which is attached to one of legs of the support body so as to extend between ends of the legs of the support body for engaging a latch with an associated lock mechanism, and a free space into which part of the latch is insertable that is bounded by the support body, by producing the locking bolt in one piece with the leg of the support body by deformation of the sheet metal into the locking bolt with a seam which runs parallel to a longitudinal axis of the bolt.

In accordance with the invention, the locking bolt itself is likewise made in one piece with the support body, specifically bent in one piece from the one of the legs. Since bending as such does not promise sufficient stiffness, the free end of the locking bolt formed by the bent section is securely joined to the other U-leg of the support body.

In terms of production engineering, the locking clamp of the invention is therefore feasible because it is a part which emerges finished from the punching/bending tool and which is formed in one piece overall from the metal sheet which is formed from a rolled strip. A single production tool is enough and production is thus economical. Here, with corresponding measures the tear strength of the entire motor vehicle locking means can be achieved as required.

In the following the invention is detailed using drawings which show several embodiments.

DETAILED DESCRIPTION OF THE PREFERRED EMBODIMENTS

A locking clamp of the type to which the invention is directed, in a motor vehicle locking means, interacts with an assigned lock mechanism which generally has a latch, especially a rotary latch, a detent pawl and different levers. For the construction of these motor vehicle locking means reference should be made to the initially addressed prior art.

Motor vehicle locking means are used for side doors, front and rear, rear doors, rear hatches, and hoods, etc. The locking clamp can be used for all types of motor vehicle locking means, especially however for hood closures and for rear doors and rear hatches. The locking clamp is characterized by special structural simplicity and the associated low production costs.

Figure 1:
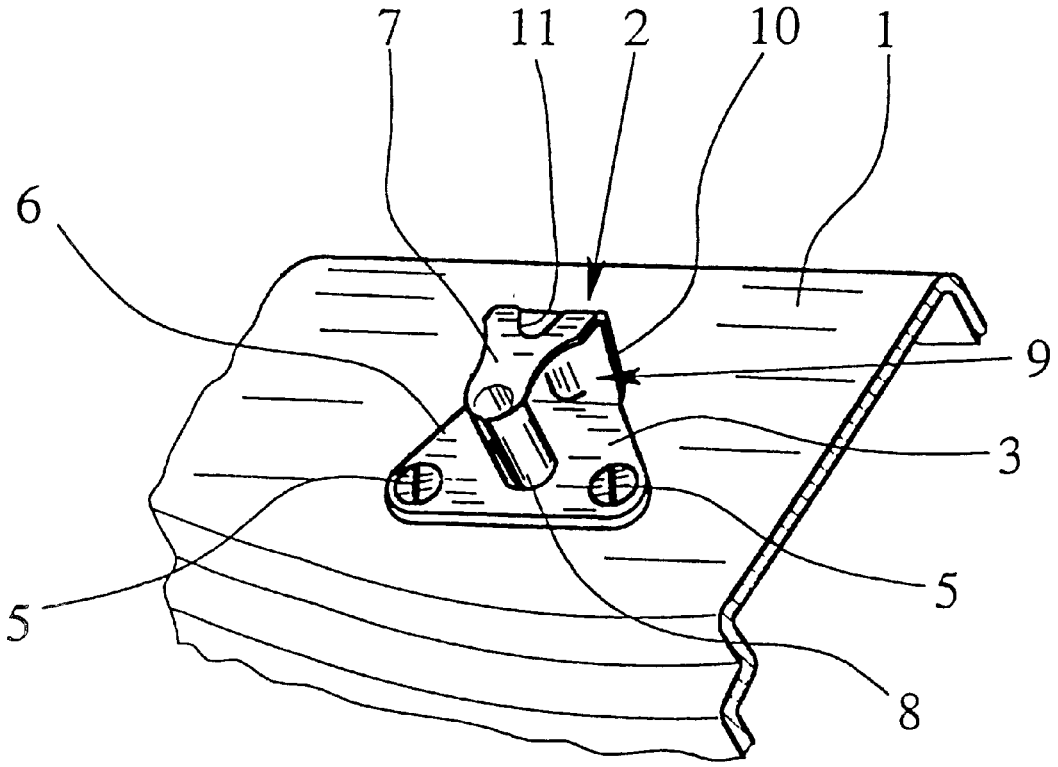
FIG. 1 shows in a perspective view a first embodiment of a locking clamp attached to a frame in the area of the rear door.

FIG. 1 shows a first embodiment of a locking clamp for a motor vehicle locking means on frame 1 of a rear door of a motor vehicle chassis. This locking clamp, first of all, has a support body 2 which is bent from a single piece of metal sheet into a U-shape and which has a section made as a base plate 3 which is to be attached to the chassis component, in this case, frame 1. In this embodiment, the base plate 3 for attachment to frame 1 has two countersunk holes 4 for screws 5 by which the support body 2 is attached to frame 1. Instead of attachment with mounting screws 5, welding of base plate 3 to the frame 1 can be used for attachment.

Between the ends of the legs 6, 7 of support body 2, there extends a locking bolt 8 which is attached to one leg 6 of the U-shape and engages a latch which is not shown, i.e., the latch of an assigned lock mechanism which is not shown here. A free space 9 into which part of the latch of the lock mechanism can fit is surrounded by support body 2 and locking bolt 8.

The aspects of the locking clamp described so far correspond to the prior art. Where the invention departs from the prior art is that the locking bolt 8 on the other leg 7 of support body 2 is a bent portion of the same single piece as the locking clamp and is securely joined at its end to the leg 6, but is not closed in one piece.

The whole locking clamp is, therefore, a single bent sheet metal part. That is, the two-part structure of the prior art is made unitary in the locking clamp with the support body and locking bolt being made as a single bent sheet metal part, so that the separate journal-like locking bolt is therefore no longer necessary.

Figure 2:
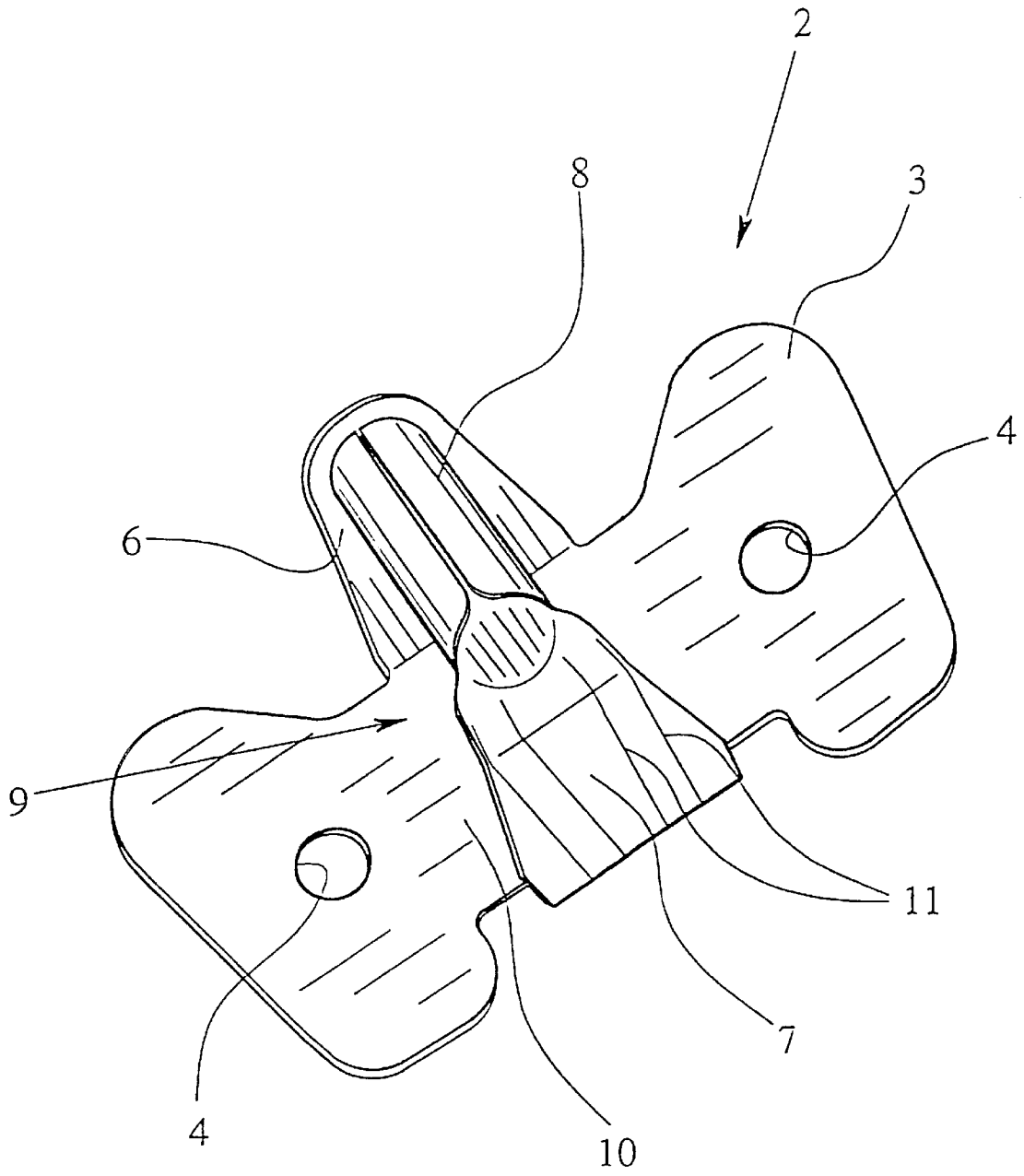
FIG. 2 shows another embodiment of a locking clamp in a perspective view.
Figure 3:
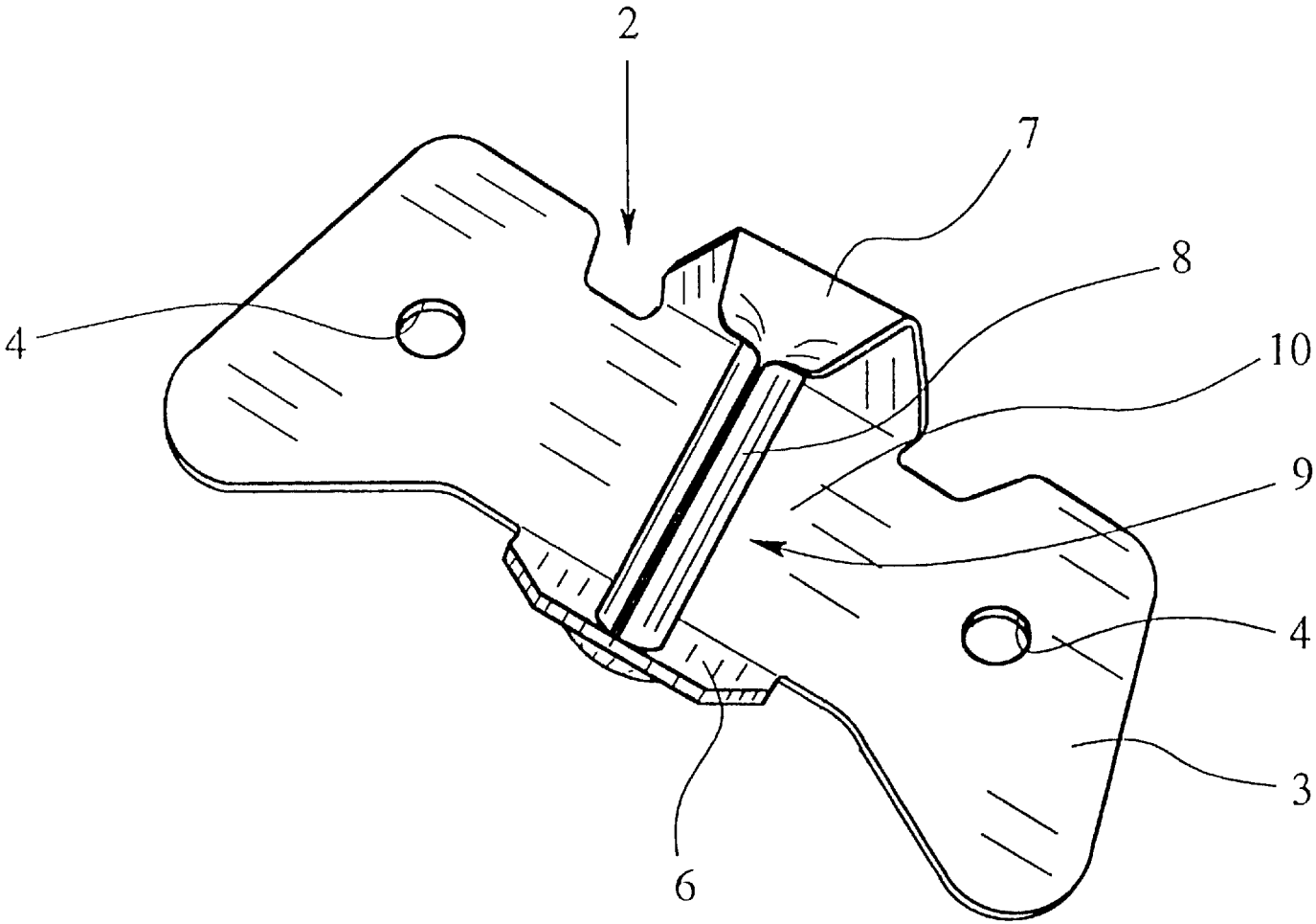
FIG. 3 shows the embodiment from FIG. 2 in an overhead view.

FIG. 1, on the one hand, and FIGS. 2, 3, on the other, show different embodiments of a locking clamp in accordance with the invention. In the embodiment of FIG. 1, base plate 3 is formed by leg 6 of support body 2, while in the embodiment in FIGS. 2 & 3, the base plate 3 is formed by the bridge 10 of the U-shape of the support body 2. The latter construction is especially suited for use in hood closures or rear hatch closures.

In the embodiment of FIGS. 2 & 3, preparation of the support body 2 using countersunk holes 4 for screw connection to the chassis component is shown. In this respect, as an alternative welding could be used, and of course in all cases then a weldable material must be used for support body 2.

With respect to the attachment of locking bolt 8 to the other U-leg 6, there are different possibilities. First of all, the end of locking bolt 8 can be butt-welded to leg 6. For example, this means of achieving the object is conceivable in the embodiment in FIG. 1, since base plate 3 is flat.

But, the embodiment of FIGS. 2 & 3 shows a different preferred version which is characterized in that the leg 6 has a through opening for the free end of locking bolt 8, and the locking bolt 8 is pressed, riveted or welded in the through opening or on the outer side of the through opening. FIG. 3 shows the end of locking bolt 8 pressed like a rivet on the outer side of the through opening in leg 6.

Nothing has yet been stated regarding how locking bolt 8 is formed from the metal sheet of support body 2. In principle, different shapes are possible. The two embodiments shown agree to the extent that the metal sheet which forms support body 2 and locking bolt 8 is rolled cylindrically in the section which forms locking bolt 8. FIG. 2 shows the butt joint in the longitudinal direction of locking bolt 8 especially clearly; it can remain open or can be welded together if high strength is desirable.

These embodiments show that, as in the prior art, support body 2 is provided with reinforcing beads 11 in order to increase the tear strength or achieve the required tear strength. This is especially the case in the area of leg 7 of which locking bolt 8 is formed as an extension.

The construction of the locking clamp makes it possible for the locking clamp to be produced entirely from galvanized metal. A subsequent galvanizing step can be saved in the production process of the locking clamp. Otherwise, the finished locking clamp would have to be galvanized, if desired.

For reasons of noise suppression, jacketing of the locking clamps and locking bolts is extensively known from the prior art. In this respect, it also applies to the locking clamp that it can be jacketed with plastic, overall or in the section which forms locking clamp 8, in particular it can be extrusion-coated. In principle, even the multilayered sleeve known from the initially explained prior art could be used.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

I claim:

1. Locking clamp for a motor vehicle locking means comprising a support body, which is formed of a single metal sheet that has been bent into a U shape having a pair of legs and a connecting bridge, and part of which forms a base plate for attaching of the locking clamp to a chassis component, and a locking bolt which extends between the legs of support body for engaging a latch with an assigned lock mechanism, a free space into which part of the latch is insertable being bounded by the support body and the locking bolt; wherein the locking bolt is made as a part of the same single metal sheet as the support body as an extension of a first of the legs of the support body which is joined at an end to a second of the legs, wherein said locking bolt is a hollow cylindric portion of said metal sheet having adjoining sheet edge extending parallel to a longitudinal axis of the locking bolt.

2. Locking clamp as claimed in claim 1, wherein the base plate is formed by said second leg of the support body.

3. Locking clamp as claimed in claim 1, wherein the base plate is formed by said connecting bridge of the support body.

4. Locking clamp as claimed in claim 1, wherein the end of the locking bolt is butt-welded to said second leg.

5. Locking clamp as claimed in claim 1, wherein said second leg has a through opening and said end of the locking bolt is connected therein by one of pressing, riveting and welding.

6. Locking clamp as claimed in claim 1, wherein the metal sheet is rolled cylindrically in the portion which forms the locking bolt.

7. Locking clamp as claimed in claim 1, wherein the support body is provided with reinforcing bends.

8. Locking clamp as claimed in claim 1, wherein the metal sheet is made of galvanized sheet metal.

9. Locking clamp as claimed in claim 1, wherein the locking clamp is galvanized.

10. Method of forming a locking clamp for a motor vehicle locking means comprising the steps of:

bending a single metal sheet into a U shape having a pair of legs and a connecting bridge and configuring a part thereof in a manner forming a base plate for attaching of the locking clamp to a chassis component; and forming a locking bolt which extends between the legs of a support body for engaging a latch with an assigned lock mechanism in a manner creating a free space, into which part of the latch is insertable, which bounded by the support body and the locking bolt;

wherein the step of forming the locking bolt is performed by deforming a portion of the same single metal sheet as the support body which is an extension of a first of the legs of the support body in a manner creating a joint at edges of the portion of the metal sheet deformed into the locking bolt which extends parallel to a longitudinal axis of the locking bolt, and then joining of an end of the locking bolt to a second of the legs.

11. Method according to claim 10, further comprising the steps of forming a through opening in said second leg; and wherein said joining step is performed by inserting said end of the locking bolt into said opening and connecting it therein by one of pressing, riveting and welding.

* * * * *